US006319109B1

(12) United States Patent
Fujii et al.

(10) Patent No.: US 6,319,109 B1
(45) Date of Patent: Nov. 20, 2001

(54) DISK-SHAPED GRINDSTONE

(75) Inventors: Tsuyoshi Fujii, Nagoya; Takeshi Nonogawa, Toki; Kenji Itoh, Kaizu-gun, all of (JP)

(73) Assignee: Noritake Co., Limited, Nagoya (JP)

( * ) Notice: Subject to any disclaimer, the term of this patent is extended or adjusted under 35 U.S.C. 154(b) by 0 days.

(21) Appl. No.: 09/582,704

(22) PCT Filed: Nov. 5, 1999

(86) PCT No.: PCT/JP99/06186

§ 371 Date: Jun. 30, 2000

§ 102(e) Date: Jun. 30, 2000

(87) PCT Pub. No.: WO00/27593

PCT Pub. Date: May 18, 2000

(30) Foreign Application Priority Data

Nov. 6, 1998 (JP) ..... 10-353714

(51) Int. Cl.[7] ..... C22C 21/00; B23F 21/03

(52) U.S. Cl. ..... 451/541; 451/544; 451/546; 51/295

(58) Field of Search ..... 451/540, 541, 451/544, 546, 548; 51/295

(56) References Cited

U.S. PATENT DOCUMENTS 5,454,855 * 10/1995 Kita et al. ..... 75/249
5,552,110 * 9/1996 Iba et al. ..... 420/406
5,922,274 * 7/1999 Suzuki et al. ..... 420/421
6,004,198 * 12/1999 Sumiyoshi ..... 451/535
6,074,278 * 6/2000 Wu et al. ..... 451/541
6,074,497 * 6/2000 Inoue et al. ..... 148/403

FOREIGN PATENT DOCUMENTS 55-97447 7/1980 (JP) .
58-191779 11/1983 (JP) .
6-91542 4/1994 (JP) .
7-62480 3/1995 (JP) .
7-116963 5/1995 (JP) .
7-171767 7/1995 (JP) .
8-90424 4/1996 (JP) .
8-243926 9/1996 (JP) .
8-257917 10/1996 (JP) .
9-176771 7/1997 (JP) .

* cited by examiner

*Primary Examiner*—Eileen P. Morgan
(74) *Attorney, Agent, or Firm*—Oliff & Berridge, PLC

(57) ABSTRACT

A disk-shaped grindstone including a base disk and an abrasive layer which is bonded to the base disk. The base disk is provided by a rapidly-solidified aluminum alloy whose major component is Si, wherein the rapidly-solidified aluminum alloy includes 15 wt %–40 wt % of the Si, 0.5 wt %–6 wt % of Cu, 0.2 wt %–3 wt % of Mg, and the balance consisting principally of aluminum. The ratio of a tensile strength of the base disk to a specific gravity of the base disk (tensile strength/specific gravity) is not smaller than 90. The ratio of a fatigue strength of the base disk to the specific gravity of the base disk (fatigue strength/specific gravity) is not smaller than 30.

14 Claims, 3 Drawing Sheets

MATERIAL CHARACTERISTICS OF BASE DISKS

| | EXAMPLE 1 | EXAMPLE 2 | COMPARATIVE EXAMPLE 1 | COMPARATIVE EXAMPLE 2 | COMPARATIVE EXAMPLE 3 | COMPARATIVE EXAMPLE 4 |
|---|---|---|---|---|---|---|
| | RAPIDLY-SOLIDIFIED ALUMINUM | RAPIDLY-SOLIDIFIED ALUMINUM | POWDER METALLURGICAL ALUMINUM | A4 ALUMINUM | HARD STEEL | CFRP (40t) |
| SPECIFIC GRAVITY | 2.6 | 2.9 | 2.6 | 2.7 | 7.8 | 1.6 |
| TENSILE STRENGTH (Mpa) | 270 | 300 | 200 | 200 | 950 | 460 |
| TENSILE ELASTIC MODULUS (Gpa) | 90 | 100 | 90 | 70 | 210 | 70 |
| FATIGUE STRENGTH (Mpa) | 100 | 110 | 65 | 65 | — | — |
| COEFFICIENT OF THERMAL EXPANSION ($\times 10^{-6}$) | 16 | 18 | 16 | 20 | 12 | 1 |
| TENSILE STRENGTH/SPECIFIC GRAVITY | 104 | 103 | 77 | 74 | 122 | 288 |
| TENSILE ELASTIC MODULUS/SPECIFIC GRAVITY | 35 | 33 | 35 | 26 | 27 | 44 |
| FATIGUE STRENGTH/SPECIFIC GRAVITY | 38 | 38 | 25 | 24 | — | — |
| IMMERSION TEST (mm) | −0.04/40 | −0.04/40 | −0.09/40 | −0.05/40 | — | — |

FIG. 4

COMPOSITION OF MOLTEN ALUMINUM

| | COMPOSITION (wt%) | | | | | | |
|---|---|---|---|---|---|---|---|
| No. | Si | Cu | Mg | Fe | Mn | Ni | Al |
| EXAMPLE 1 | 30 | 2 | 1 | | | | bal. |
| EXAMPLE 2 | 18 | 2 | 1 | 3 | | | bal. |

FIG. 5

MATERIAL CHARACTERISTICS OF BASE DISKS

| | EXAMPLE 1 | EXAMPLE 2 | COMPARATIVE EXAMPLE 1 | COMPARATIVE EXAMPLE 2 | COMPARATIVE EXAMPLE 3 | COMPARATIVE EXAMPLE 4 |
|---|---|---|---|---|---|---|
| | RAPIDLY-SOLIDIFIED ALUMINUM | RAPIDLY-SOLIDIFIED ALUMINUM | POWDER METALLURGICAL ALUMINUM | A4 ALUMINUM | HARD STEEL | CFRP (40t) |
| SPECIFIC GRAVITY | 2.6 | 2.9 | 2.6 | 2.7 | 7.8 | 1.6 |
| TENSILE STRENGTH (Mpa) | 270 | 300 | 200 | 200 | 950 | 460 |
| TENSILE ELASTIC MODULUS (Gpa) | 90 | 100 | 90 | 70 | 210 | 70 |
| FATIGUE STRENGTH (Mpa) | 100 | 110 | 65 | 65 | — | — |
| COEFFICIENT OF THERMAL EXPANSION ($\times 10^{-6}$) | 16 | 18 | 16 | 20 | 12 | 1 |
| TENSILE STRENGTH/SPECIFIC GRAVITY | 104 | 103 | 77 | 74 | 122 | 288 |
| TENSILE ELASTIC MODULUS/SPECIFIC GRAVITY | 35 | 33 | 35 | 26 | 27 | 44 |
| FATIGUE STRENGTH/SPECIFIC GRAVITY | 38 | 38 | 25 | 24 | — | — |
| IMMERSION TEST (mm) | −0.04/40 | −0.04/40 | −0.09/40 | −0.05/40 | — | — |

DISK-SHAPED GRINDSTONE

TECHNICAL FIELD

The present invention relates to a disk-shaped grindstone having an abrasive layer which is bonded to a grinding surface of the grindstone, for use in a rotary grinding operation. More particularly, the invention is concerned with a disk-shaped grindstone having a base disk and an abrasive layer which includes diamond abrasive grains, CBN (cubic boron nitrides) abrasive grains or other super abrasive grains that are held together and which is bonded to an outer circumferential surface of the base disk, for use in a rotary grinding operation performed at a high peripheral speed.

BACKGROUND ART

There is known a high-speed grinding process with a vitrified CBN grindstone having CBN abrasive grains that are held together by a vitrified (inorganic) bonding agent. Such a high-speed grinding process with the vitrified CBN grindstone provides the advantages of reduced wearing amount of the grindstone, prolonged lifetime of the grindstone until the grindstone requires to be dressed, improved efficiency of the grinding operation and improved quality of the ground workpiece. Such a high-speed grinding process has been practiced principally in an outer cylindrical surface grinding operation in which a grindstone having a comparatively small width is generally used, but is recently required to be practiced in also an operation with a centerless grinding apparatus in which a grindstone having a comparatively large axial length is generally used. That is, there is a demand for practice of a high-speed grinding operation at a peripheral speed of the grindstone which is not smaller than about 60m/s, in also an operation with a centerless grinding apparatus. To meet this demand, the used grindstone requires to have a sufficiently high degree of strength for permitting a high-speed revolution thereof, so as to assure a high degree of safety in the grinding operation. Where the grindstone has a mounting hole formed in its center, a maximum stress tends to act on a peripheral edge portion thereof defining the mounting hole. Therefore, a circumferential wall of the mounting hole has to be provided by a material having a sufficiently high degree of braking strength.

In this view, there is proposed a vitrified grindstone including a peripheral edge portion which defines the mounting hole and which is provided by a material having a strength higher than that of a material providing the other portion of the grindstone, so as to permit a higher revolution of the grindstone. Such a proposed grindstone includes a base disk which is made of a steel, aluminum or CFRP (carbon-fiber reinforced plastic), and a single integral annular vitrified abrasive solid mass or a multiplicity of vitrified abrasive segments which is bonded to an outer circumferential surface of the base disk.

However, such a proposed grindstone is difficult to be practically used in an operation since the proposed grindstone tends to have a weight larger than 100Kg where the size of the grindstone is large and the base disk of the grindstone is made of a steel. For permitting the grindstone having such a large weight to be rotated at a high peripheral speed, it is necessary for increasing the power of the grinding apparatus, increasing the rigidity of the axis on which the grindstone is mounted, or even employing a grinding apparatus having a larger degree of overall rigidity.

There are various problems also where the base disk is made of CFRP which is a material suitable for the base disk owing to its light weigh and high strength. For example, it is difficult to provide the base disk with a large thickness, where the base disk is produced by using CFRP as the material, according to a pseudo-isotropic-laminating method. Further, in the interest of minimizing elastic elongation of the base disk and thereby reducing the stress acting on the abrasive layer, CFRP has to have a high degree of elastic modulus, thereby resulting in an increased cost of the production.

There is proposed a base disk having a double structure in which only a radially outer layer is provided by CFRP, as disclosed in JP-A-06-91542. Such a double structure provides various advantages, for example, making it possible to produce the base disk with a reduced amount of CFRP, and to minimize elastic elongation of an outer peripheral portion of the base disk. However, the double structure leads to an increase in the production cost of the base disk, and this increase can not be easily compensated by an increased productivity provided by an increased peripheral speed of the grindstone in a grinding operation. The increase in the production cost of the base disk could be compensated if the grinding operation is performed with a considerably high peripheral speed of the grindstone exceeding 100 m/s, but could not be compensated where the grinding operation is performed with a peripheral speed of the grindstone ranging from 60 to 100 m/s because the grinding operation with the peripheral speed not so high as 100 m/s does not provide a sufficiently increased profit. Further, the abrasive layer or segments can not be stripped from the base disk, by baking the abrasive layer or segment, because the radially outer layer of the base disk is constituted by CFRP. Thus, it is necessary to remove the abrasive layer or segments from the base disk by physically cutting off the abrasive layer or segments, possibly leading to an increased operation cost. In this method, even a portion of the CFRP is undesirably cut off, and the outside diameter of the base disk is accordingly reduced, every time the abrasive layer or segments is removed, resulting in difficulty for repeated reutilization of the base disk. The base disk provides also an environmental disadvantage that the CFRP can not be recycled when the base disk is discarded.

In the above view, there is proposed a base disk which is provided by an aluminum alloy having a modified property. The proposed base disk is produced by compressing and heating aluminum alloy powders and silicone (Si) powders according to a powder metallurgical method, as disclosed in JP-A-07-116963. However, in such a base disk made of the aluminum alloy, the silicone powders are not distributed evenly over the entirety of the base disk due to insufficient dispersion of the silicon powders, resulting in an insufficiently high degree of strength of the base disk. The powder metallurgical method leads to an increased operation cost due to the required compressing and heating processes. A high degree of porosity of the base disk makes it difficult to obtain a high degree of strength of the base disk, making it impossible to increase the thickness of the base disk.

DISCLOSURE OF INVENTION

The present invention was developed under the above-described background situation and has an object of providing a disk-shaped grindstone which has a light weight and a sufficiently high degree of strength permitting a revolution thereof at a high peripheral speed, and which permits reutilization of a base disk thereof.

The above object may be achieved by the essence of the first invention which is a disk-shaped grindstone including a base disk and an abrasive layer which is bonded to the base disk, wherein the base disk is provided by a rapidly-solidified aluminum alloy including Si as a major component thereof. The disk-shaped grindstone is characterized in that the rapidly-solidified aluminum alloy whose major component is Si, wherein the rapidly-solidified aluminum alloy includes 15 wt %–40 wt % of the Si, 0.5 wt %–6 wt % of Cu, 0.2 wt %–3 wt % of Mg, and the remaining consisting principally of aluminum, and in that the ratio of a tensile strength of the base disk to a specific gravity of the base disk (tensile strength [MPa]/specific gravity) is not smaller than 90, and the ratio of a fatigue strength of the base disk to the specific gravity of the base disk (fatigue strength [MPa]/specific gravity) is not smaller than 30.

According to the present first invention, a molten aluminum alloy including Si is previously rapidly solidified by rapidly cooling the molten aluminum alloy, into a large solid mass, and the large solid mass is then cut into pieces each having a predetermined size. Thus, a multiplicity of the base disks can be produced at a time through a single process of producing the alloy. The multiplicity of base disks do not require respective powder metallurgical steps to be produced. Namely, the base disks do not have to be formed individually from each other, thereby leading to a reduced producing cost.

Further, according to the present first invention, the content of Si in the aluminum alloy is not smaller than 15 wt %, whereby elastic modulus of the base disk is increased while coefficient of thermal expansion of the base disk is reduced. During rotation of the grindstone at a high peripheral speed, the elastic elongation and deformation of the base disk due to generation of centrifugal force are minimized by the increased elastics modulus of the base disk, thereby advantageously preventing the abrasive layer from being separated from the base disk. The thermal deformation of the base disk is minimized by the reduced coefficient of thermal expansion, thereby reducing a residual stress between the abrasive layer and the base disk that are bonded together, and accordingly increasing the bonding strength, resulting in a reduced thermal influence on the machining accuracy. Since the content of Si in the aluminum alloy is not larger than 40 wt % as well as not smaller than 15 wt %, the base disk is prevented from being excessively brittle.

Further, according to the present first invention, the molten aluminum alloy including 15 wt %–40 wt % of Si is rapidly solidified by rapidly cooling the molten aluminum alloy, into the solid aluminum alloy, whereby small particles of Si each having a size not larger than 5 $\mu$m are deposited and distributed evenly over the entirety of the aluminum alloy, so that the aluminum alloy has a high degree of strength in its entirety with a high degree of stability.

Further, according to the present first invention, the molten aluminum alloy including 15 wt %–40 wt % of Si is rapidly solidified by rapidly cooling the molten aluminum alloy, into the solid aluminum alloy, whereby the small Si particles are deposited in the aluminum alloy and distributed evenly over the entirety of the aluminum alloy, preventing the aluminum alloy from being brittle and thereby preventing the strength of the aluminum alloy from being reduced, so that the aluminum alloy has a high degree of strength in its entirety with a high degree of stability.

Further, according to the present first invention, the aluminum alloy includes 0.5 wt %–6 wt % of Cu and 0.2 wt %–3 wt % of Mg which cooperate with each other to form $Al_2CuMg$ phase, whereby the strength of the base disk is prevented from being reduced by an age or precipitation hardening effect after the aluminum alloy has been heated at 200–400° C., so that the strength of the base disk at an ordinary temperature is increased. If the content of Cu is not larger than 0.5 wt % or that of Mg is not larger than 2 wt % in the aluminum alloy, it would be difficult to obtain the above-described age or precipitation hardening effect. If the content of Cu is not smaller than 6 wt % or that of Mg is not smaller than 3 wt % in the aluminum alloy, the aluminum alloy would suffer from reduced degrees of corrosion resistance and machinability.

Further, according to the present first invention, the ratio of the tensile strength of the base disk (aluminum alloy) to the specific gravity of the base disk (tensile strength [MPa]/specific gravity) is not smaller than 90, and the ratio of the fatigue strength of the base disk to the specific gravity of the base disk (tensile strength [MPa]/specific gravity) is not smaller than 30, so that the base disk has a higher stability in its strength, permitting the base disk to be used for a longer time and to be reutilized for a longer period.

Further, according to the present first invention, the base disk provided by the aluminum alloy can be reutilized without being discarded, thereby providing an environmental advantage.

The above object may be achieved by also the essence of the second invention which is a disk-shaped grindstone including a base disk and an abrasive layer which is bonded to the base disk, the disk-shaped grindstone being characterized in that:

the base disk is provided by a rapidly-solidified aluminum alloy whose major component is Si, wherein the rapidly-solidified aluminum alloy includes 15 wt %–40 wt % of the Si, 0.5 wt %–6 wt % of Cu, 0.2 wt %–3 wt % of Mg, 3 wt %–10 wt % of at least one of Fe, Mn and Ni, and the remaining consisting principally of aluminum; and in that:

the ratio of a tensile strength of the base disk to a specific gravity of the base disk (tensile strength [MPa]/specific gravity) is not smaller than 90, and the ratio of a fatigue strength of the base disk to the specific gravity of the base disk (fatigue strength [MPa]/specific gravity) is not smaller than 30.

The arrangement according to the second invention provides the same advantage as that provided by the arrangement according to the first invention. In addition, the arrangement according to the second invention provides the other advantage that the tensile strength and the fatigue strength of the base disk are further increased since 3 wt %–10 wt % of at least one of iron (Fe), manganese (Mn) and nickel (Ni) is also included in the aluminum alloy.

In the first and second inventions, the rapidly-solidified aluminum alloy whose major component is Si preferably includes Si particles whose average diameter is not larger than 5 $\mu$m . This arrangement permits the Si particles deposited in the rapidly-solidified aluminum alloy to be made small and distributed evenly over the entirety of the aluminum alloy, thereby preventing the aluminum alloy from being brittle and accordingly preventing the strength of the aluminum alloy from being reduced, so that the aluminum alloy has a high degree of strength in its entirety with a high degree of stability.

The above-described rapidly-solidified aluminum alloy whose major component is Si preferably has a porosity not larger than 1 vol %. This arrangement further increases the strength of the aluminum alloy, and improves its resistance to a grinding fluid.

The above-described disk-shaped grindstone is preferably a grindstone which is to be used for a centerless grinding operation and which has a plurality of abrasive segments bonded to an outer circumferential surface of the base disk. This arrangement has the advantage that the grindstone is more easily formed than where a single integral annular abrasive mass is bonded to the outer circumferential surface of the base disk.

Each of the above-described abrasive segments preferably includes a radially outer layer and a radially inner layer which are formed integrally with each other, wherein the radially outer layer includes super abrasive grains that held together by a bonding agent while the radially inner layer includes abrasive grains which have a lower degree of hardness than the super abrasive grains and which are held together by the same bonding agent as the bonding agent. According to this arrangement, the super abrasive grains are provided only in a portion of each abrasive segment which portion is actually dedicated to a grinding operation, thereby reducing the manufacturing cost. The abrasive grains in the radially inner layer are held together by the same bonding agent as that used in the radially outer layer, whereby the radially inner and outer layers are firmly integrated with each other.

The above-described super abrasive grains preferably have been subjected to a heat treatment, so as to reduce the toughness, thereby permitting fine pulverization of the supper abrasive grains. Since the fine pulverization of the supper abrasive grains is permitted, it is possible to sufficiently effect a dressing or truing operation prior to a grinding operation, for restoring sharpness of the supper abrasive grains and providing a sufficient degree of surface roughness of the radially outer layer, and also to prevent large fragmentation or removal of the supper abrasive grains, resulting in a prolonged life of the grindstone. It is further appreciated that the pores of the grindstone are prevented from being clogged by grinding chips or powders produced during the grinding operation, and accordingly the grinding chips or powders are prevented from being fused in the pores, thereby facilitating the grinding operation even with a workpiece whose chips or powders are easily fused.

The above-described heat treatment is performed at a temperature of 400–1200° C. under vacuum or in a non-oxidizing gas atmosphere in the absence of oxygen, so as to sufficiently reduce the toughness of the supper abrasive grains without deteriorating the grinding performance of the supper abrasive grains.

BRIEF DECRIPTION OF DRAWINGS

FIG. 4 is a table showing the composition of molten aluminum alloy used for manufacturing the base disks of Examples 1 and 2.

FIG. 5 is a table showing material characteristics of the base disks of Examples 1 and 2, as compared with material characteristics of the base disks of Comparative Examples.

BEST MODE FOR CARRYING OUT THE INVENTION

Figure 1:
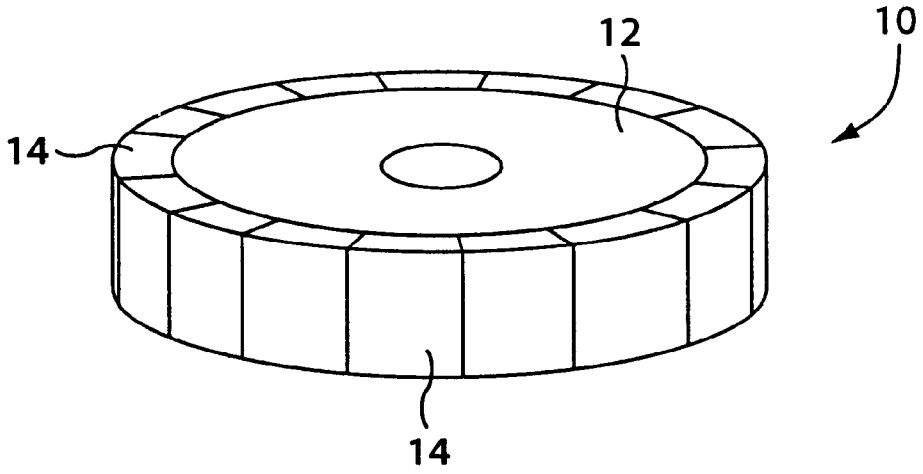
FIG. 1 is a perspective view showing a disk-shaped grindstone according to one embodiment of the present invention.
Figure 2:
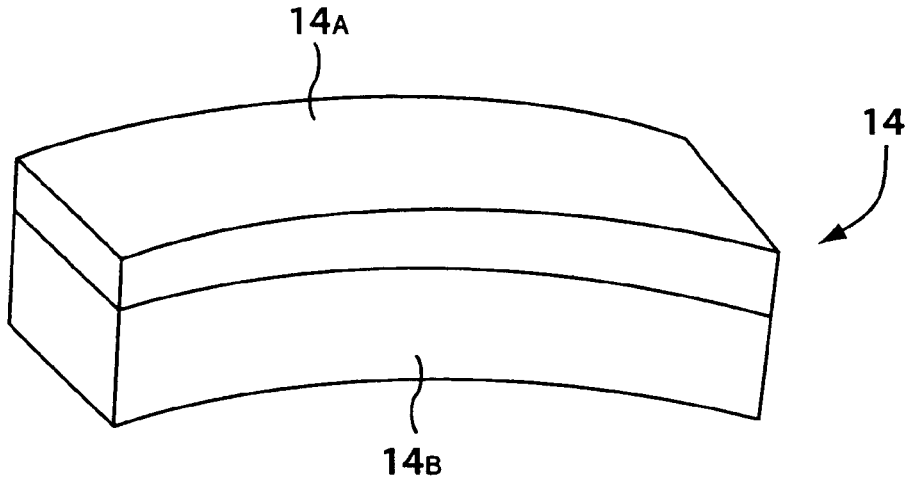
FIG. 2 is a perspective view showing one of abrasive segments which are bonded to an outer circumferential surface of a base disk of the disk-shaped grindstone of FIG. 1.

FIG. 1 shows a disk-shaped grindstone 10 according to one embodiment of the present invention. This disk-shaped grindstone 10 is to be used for a super high speed grinding operation in which the grindstone 10 is rotated at a peripheral speed thereof equal to or larger than 100 m/s. The disk-shaped grindstone 10 includes a base disk (metallic base) 12 which corresponds to a core portion of the grindstone 10, and abrasive segments 14 which correspond to an abrasive layer bonded to an outer circumferential surface of the base disk 12. The base disk 12 is made of an aluminum alloy, and has a circular shape and a large thickness. Each of the abrasive segments 14 is a plate member which is curved so as to have a generally arcuate shape whose curvature is equal to that of the outer circumferential surface of the base disk 12, as shown in FIG. 2. The abrasive segments 14 are bonded to the outer circumferential surface of the base disk 12, for example, with an epoxy resin adhesive, such that the abrasive segments 14 are arranged in a circular array without any gap between adjacent ones of the abrasive segments 14. Each abrasive segment 14 consists of a radially outer layer $\mathbf{14}_A$ which is dedicated exclusively to a grinding operation, and a radially inner layer $\mathbf{14}_B$ which is formed integrally with the outer layer 14 in a simultaneous firing process. The radially inner layer $\mathbf{14}_B$ functions as a base support layer for mechanically supporting the radially outer layer $\mathbf{14}_A$. Each of the radially outer and inner layers $\mathbf{14}_A$, $\mathbf{14}_B$ consists of abrasive grains and an organic or inorganic bonding agent by which the abrasive grains are held together. The bonding agents used in the respective radially outer and inner layer $\mathbf{14}_A$, $\mathbf{14}_B$ are the same in kind, while the abrasive grains used in the respective radially outer and inner layers $\mathbf{14}_A$, $\mathbf{14}_B$ are different in kind from each other. The radially outer layer $\mathbf{14}_A$ includes super abrasive grains, such as CBN abrasive grains or diamond abrasive grains, which have a Knoop hardness value of at least 3000, while the radially inner layer $\mathbf{14}_B$ includes ordinary abrasive grains such as fused alumina abrasive grains or silicon carbide abrasive grains. The super abrasive grains are included in the radially outer layer $\mathbf{14}_A$ such that the supper abrasive grains have a concentration of not larger than about 10–230, preferably, about 20–200. The supper abrasive grains have a size within a range of 60–800 meshes. The lower and upper limits of 60 meshes and 800 meshes respectively correspond to 220 $\mu$m and 20 $\mu$m in the average particle diameter. The supper abrasive grains are subjected to a heat treatment at a temperature of 400–1200° C. under vacuum or in a gas atmosphere in the absence of oxygen, so as to reduce a toughness of the supper abrasive grains. If the temperature is lower than 400° C., the toughness of the supper abrasive gains is not sufficiently reduced. If the temperature is higher than 1200° C., the supper abrasive grains are excessively pulverized whereby the grinding performance and the durability of the supper abrasive grains are deteriorated.

Figure 3:
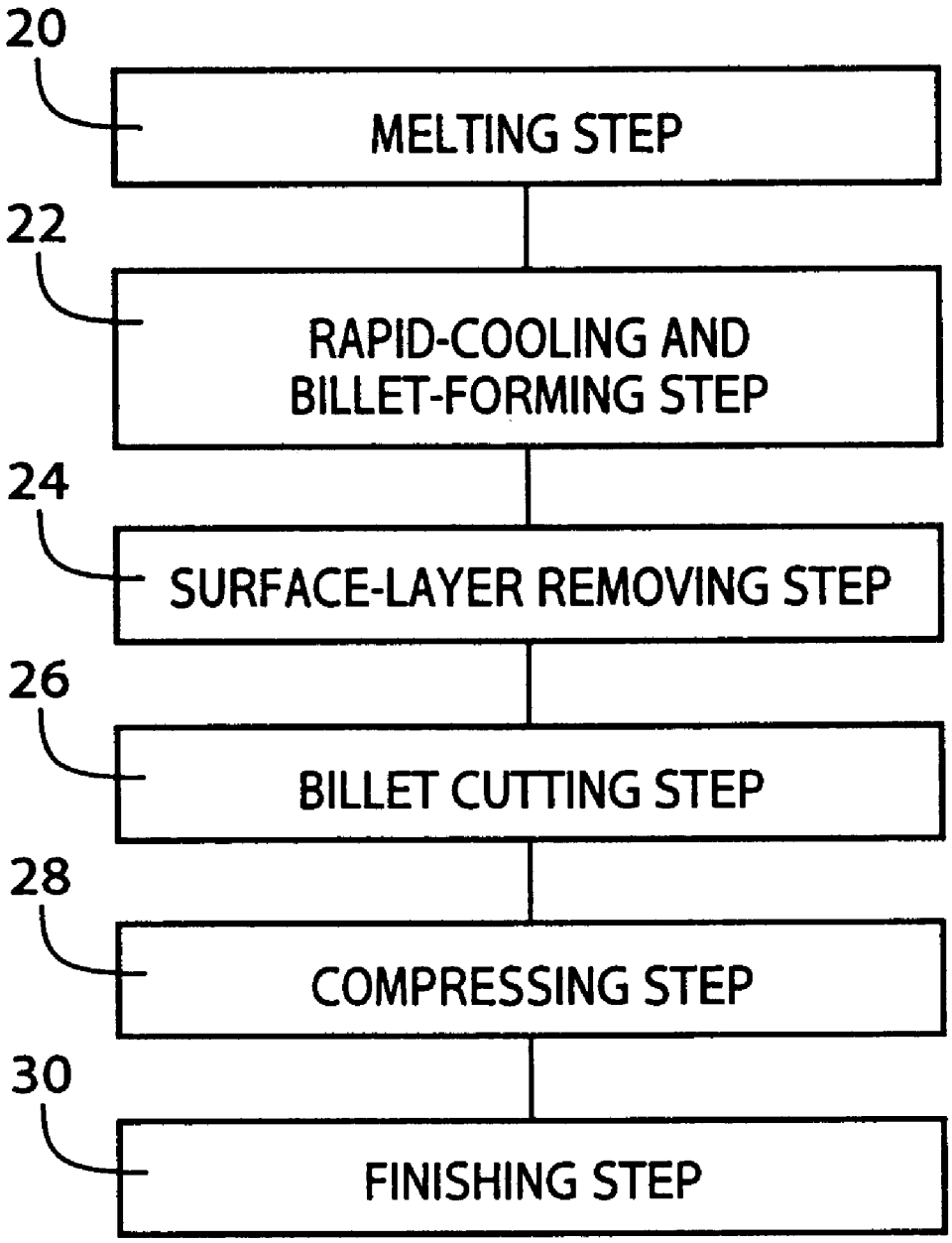
FIG. 3 is a view showing a process of manufacturing the base disk used in the disk-shaped grindstone of FIG. 1.

The base disk 12 is produced, for example, according to a production process as shown in FIG. 3. A melting step 20 is first implemented to obtain a molten material which includes 15 wt %–40 wt % of Si, 0.5 wt %–6 wt % of Cu, 0.2 wt %–3 wt % of Mg, and the remaining which is constituted principally by aluminum, by mixing and melting various kinds of materials put into a melting furnace (not shown). The amounts of the respective put materials are adjusted so as to obtain the above-described weight distribution. The above-described remaining includes impurities which inevitably enters the mixture in the production process. The melting step 20 is followed by a rapid-cooling and billet-forming step 22 in which, for example, a nitrogen gas is blasted to the flowing molten material obtained in the melting step 20, whereby the molten material is separated into small droplets, and then the small droplets are sprayed into a cylindrical forming space which is open in a surface of a collector. In this step, the sprayed droplets are rapidly cooled and start to be solidified, so that the droplets, which are melted or semi-melted, adhere to an inner wall surface of the cylindrical-shaped forming space of the collector. The melted or semi-melted droplets adhering to the inner wall surface of the forming space are cooled and solidified in the presence of the gas, while functioning as bonding agents for bonding themselves to each other, so that a cylindrical billet having a size of, for example, about 400 mmφ×750 mm is obtained. The rapid-cooling and billet-forming step 22 is followed by a surface-layer removing step 24 which is implemented to remove a surface layer of the cylindrical billet which layer has a high porosity and a thickness of, for example, about 5 mm, by a machining operation. In a billet cutting step 26, the cylindrical billet is cut to have a size which is slightly larger than that of the base disk 12. The billet cutting step 26 is followed by a compressing step 28 in which the cut billet is subjected to a densifying treatment so as to be compressed by cold- or hot-forging, hot-pressing, or extruding operation, so that the billet has a porosity not larger than 1 vol %. In a finishing step 30, the billet is finished to have a desired size by a machining operation whereby the base disk 12 is finally obtained.

The thus obtained base disk 12 has characteristics permitting a high speed grinding operation in which the disk-shaped grindstone 10 is rotated at a high peripheral speed not smaller than 100 m/s. That is, the aluminum alloy constituting the base disk 12 has a light weight, and the Si particles deposited in the aluminum alloy by the rapid cooling are homogeneous and have a small size not larger than 5 μm . Further, the porosity of the aluminum alloy is reduced to be not larger than 1 vol %, so that the base disk 12 has a high degree of strength in its entirety and elastic elongation thereof is accordingly minimized. The tensile strength and the fatigue strength of the base disk 12 are thus increased, so that the ratio of the tensile strength to a specific gravity of the base disk 12 (tensile strength [MPa]/specific gravity) is not smaller than 90, and the ratio of the fatigue strength to the specific gravity of the base disk 12 (fatigue strength [MPa]/specific gravity) is not smaller than 30. The base disk 12 can be produced without any problem even if the base disk 12 has a large width so as to be used for a grindstone having a large width. In addition, a plurality of base disks 12 can be obtained at a single step of melting the aluminum alloy, thereby leading to a reduced manufacturing cost. The above-described reduced porosity of the aluminum alloy provides the base disk 12 with a high degree of corrosion resistance. The abrasive segments 14 can be easily removed from the base disk 12, by decomposing the adhesive with application of heat to the adhesive, or by dissolving the adhesive with a solvent. The high degree of corrosion resistance of the base disk 12 and the easy removal of the adhesive facilitate a reutilization of the base disk 12.

Another embodiment of the present invention will be described. In the following embodiment, the same reference numerals as used in the above-described embodiment will be used to identify the elements which are identical to those in the above-described embodiment. No description of these elements will be provided.

The base disk 12 of the present embodiment is produced according to a production process similar to that as shown in FIG. 3. The base disk 12 is provided by an aluminum alloy including 15 wt % –40 wt % of Si, 0.50 wt %–6 wt % of Cu, 0.2 wt % –wt % of Mg, 3 wt %–10 wt % of at least one of Fe, Mn and Ni, and the remaining which is constituted principally by aluminum. The aluminum alloy includes Si particles whose average diameter is not larger than 5μm , and has a porosity not larger than 1 vol %. The ratio of a tensile strength of the base disk 12 to a specific gravity of the base disk 12 (tensile strength [MPa]/specific gravity) is not smaller than 90, and the ratio of a fatigue strength of the base disk 12 to the specific gravity of the base disk 12 (fatigue strength [MPa]/specific gravity) is not smaller than 30. That is, the base disk 12 of the present embodiment is different from the base disk 12 of the above-described embodiment, in that the base disk 12 of the present embodiment additionally includes 3 wt %–10 wt % of at least one of Fe, Mn and Ni, which is additionally put into the melting furnace at the above-described melting step 20.

The present embodiment provides the same advantages as the above-described embodiment provides, and also the other advantage that the tensile strength and the fatigue strength of the base disk are further increased owing to the presence of 3 wt %–10 wt % of at least one of Fe, Mn and Ni therein.

There will be described material characteristics test and operational stability tests which were conducted by the present inventors. In the material characteristics tests, six test pieces were used to be subjected to several kinds of tests under respective conditions as specified below. The six test pieces consisted of a test piece (referred to as Example 1) which had the same composition as the base disk of the first embodiment and which was produced according to the same production process as that in the first embodiment; a test piece (referred to as Example 2) which had the same composition as the base disk of the second embodiment and which was produced according to the same production process as that in the second embodiment; a test piece (referred to as Comparative Example 1) which had the same composition as the base disk of the first embodiment and which was produced according to a powder metallurgical method; a test piece (referred to as Comparative Example 2) which was made of 4A aluminum alloy and which was produced according to a known method; a test piece (referred to as Comparative Example 3) which was made of a hard steel and which was produced according to a known method; and a test piece (referred to as Comparative Example 4) which had a double structure wherein only the radially outer layer is provided by CFRP and which was produced according to a known method. FIG. 4 shows the compositions of Examples 1 and 2. FIG. 5 shows the material characteristics of Examples 1 and 2 and Comparative Examples 1–4.

[Tension Test and Elasticity Test]

Measured according to JISZ2241 by using a universal testing machine.

Measured portion: Straight portion of 7 mm×3 mm

[Fatigue Test]

Ono-type rotating bending fatigue test (1750 r.p.m)

Measured portion: Cylindrical portion of 8 mmϕ×15 mm

[Immersion Test]

Measured according to an alternate immersion environmental test. Specifically, an amount of reduction in dimension of each test piece (40 mm×5 mm×5 mm) was measured after the test piece was continuously subjected to an operation for one week in which the test piece was first immersed, for 30 minutes, in a testing liquid in the form of a grinding liquid (chemical solution type: dilution ratio of 50 times) having a temperature of 40° C., and then dried at a temperature of 50° C. for 30 minutes. In the operation, the immersing step and the drying step were alternately executed.

As is apparent from FIG. 5, the rapidly-solidified aluminum alloy of Example 1 had almost the same values of the specific gravity, elastic modulus and coefficient of thermal expansion as the powder metallurgical aluminum alloy of Comparative Example 1, but had a higher degree of tensile strength and a higher degree of fatigue strength than the aluminum alloy of Comparative Example 1. Accordingly, the aluminum alloy of Example 1 can be advantageously used as a base disk of a grindstone for use in a rotary grinding operation performed with a high peripheral speed. Further, as is apparent from the result of the immersion test, the rapidly-solidified aluminum alloys of Examples 1 and 2 had smaller amount of reduction in dimension than the powder metallurgical aluminum alloy of Comparative Example 1. Namely, the aluminum alloys of Examples 1 and 2 exhibited a higher degree of corrosion resistance than the aluminum alloy of Comparative Example 1. It is noted that a surface of the base disk may be coated, for example, with alumite by a suitable treatment, so that the base disk has an increased corrosion resistance.

The operational stability tests will be described. A base disk (outside diameter 237 mmϕ×thickness 30 mm T×mounting hole diameter 20 mm H) was first produced according to the production process (as shown in FIG. 3) of the first embodiment, and abrasive segments (length 40 mm×width 30 mm×thickness 7 mm) were then bonded to an outer circumferential surface of the base disk with an epoxy resin adhesive, so that a disk-shaped grindstone was formed. Each of the abrasive segments consisted of a radially outer layer (thickness 3 mm) and a radially inner layer which were formed integrally with each other. The radially outer layer consisted of 50 parts by volume of CBN abrasives of #80/#100, 16 parts by volume of vitrified bond and 34 parts by volume of pores. The radially inner layer consists of 50 parts by volume of mullite powders of #180/#220, 16 parts by volume of vitrified bond and 34 parts by volume of pores. The formed disk-shaped grindstone was subjected to a destruction test with a spintester under vacuum, and the grindstone was destroyed when the value of peripheral speed of the grindstone was increased to 335 m/s. If it is assumed that the peripheral speed in practical use can be increased to a half of the destruction value, it could be increased to 167 m/s. The distortion amount in an outer peripheral portion of the grindstone upon the destruction was calculated as $5.9\times10^{31\ 4}$ by FEM analysis.

A disk-shaped grindstone (outside diameter 455 mmϕ× thickness 100 mm T×mounting hole diameter 203.2 mmH) to be used for a centerless grinding operation was formed by using a base disk (outside diameter 439 mm×thickness 100 mmT×mounting hole diameter 203.2 mmH) which was produced according to the production process (as shown in FIG. 3) of the first embodiment. A centrifugal force or stress acting on the base disk during rotation of the grindstone at a peripheral speed of 100 m/s was measured by FEM analysis, and the measured value was about 23 MPa. This measured value corresponds to about one-forth (¼) of the fatigue strength of Example 1 which is shown in FIG. 5, and corresponds to about6 one-eleventh (1/11) of the tensile strength of Example 1 which is shown in FIG. 5. Thus, a factor of safety in terms of the fatigue strength is about 4, and a factor of safety in terms of the tensile strength is about 1. The distortion amount in an outer peripheral portion of the grindstone during the rotation of the grindstone at the peripheral speed of 100 m/s was calculated as $0.98\times10^{-4}$ by the above-described FEM analysis. If it is assumed that the grindstone would be destroyed when the distortion amount in the outer peripheral portion of the grindstone is increased to the above-described value, i.e., $5.9\times10^{31\ 4}$, the factor of safety will be calculated as $(5.9\times10^{31\ 4}/0.98\times10^{-4})^{1/2}=2.5$ since the distortion amount in the outer peripheral portion is proportional to the square of the peripheral speed value. The test revealed that the disk-shaped grindstone and the base disk had sufficiently high degree of safety.

It is generally considered that the factor of safety as to fatigue strength per a unit specific gravity should be at least three times while that as to tensile strength per the unit specific gravity should be at least about ten times, for assuring a sufficiently high degree of safety of the base disk. In this respect, the ratio of the fatigue strength to the specific gravity (fatigue strength [MPa]/specific gravity) should be at least 30 MPa since 23 MPa×3/2.6=27, while the ratio of the tensile strength to the specific gravity (tensile strength [MPa]/specific gravity) should be at least 90 MPa since 23 MPa×10/2.6=88. As is apparent from FIG. 5, the ratio of the fatigue strength to the specific gravity and the ratio of the tensile strength to the specific gravity in Comparative Examples 1 and 2 are smaller than the above-described minimum values for assuring the safety, while those in Examples 1 and 2 are larger than the above-described minimum values.

What is claimed is:

1. A disk-shaped grindstone comprising a base disk and an abrasive layer which is bonded to said base disk, said disk-shaped grindstone being characterized in that:

said base disk is provided by a rapidly-solidified aluminum alloy whose major component is Si, wherein said rapidly-solidified aluminum alloy includes 15 wt %–40 wt % of said Si, 0.5 wt %–6 wt % of Cu, 0.2 wt %–3 wt % of Mg, and the balance consisting principally of aluminum; and in that:

the ratio of a tensile strength of said base disk to a specific gravity of said base disk (tensile strength [MPa]/specific gravity) is not smaller than 90, and the ratio of a fatigue strength of said base disk to said specific gravity of said base disk (fatigue strength [MPa]/specific gravity) is not smaller than 30.

2. A disk-shaped grindstone according to claim 1, wherein said rapidly-solidified aluminum alloy includes Si particles whose average diameter is not larger than 5 μm.

3. A disk-shaped grindstone according to claim 1, wherein said rapidly-solidified aluminum alloy has a porosity not larger than 1 vol %.

4. A disk-shaped grindstone according to claim 1, wherein a plurality of abrasive segments are bonded to an outer circumferential surface of said base disk, said disk-shaped grindstone being used for a centerless grinding operation.

5. A disk-shaped grindstone according to claim 1, wherein each of said abrasive segments includes a radially outer layer and a radially inner layer which are formed integrally with each other, said radially outer layer including super abrasive grains that are held together by a bonding agent, said radially inner layer including abrasive grains which have a lower degree of hardness than said super abrasive grains and which are held together by said boding agent.

6. A disk-shaped grindstone according to claim 5, wherein said super abrasive grains have been subjected to a heat treatment, so as to reduce a toughness of said supper abrasive grains.

7. A disk-shaped grindstone according to claim 6, wherein said heat treatment is performed at a temperature of 400–1200° C. under vacuum or in a non-oxidizing gas atmosphere in the absence of oxygen.

8. A disk-shaped grindstone comprising a base disk and an abrasive layer which is bonded to said base disk, said disk-shaped grindstone being characterized in that:

said base disk is provided by a rapidly-solidified aluminum alloy whose major component is Si, wherein said rapidly-solidified aluminum alloy includes 15 wt %–40 wt % of said Si, 0.5 wt %–6 wt % of Cu, 0.2 wt %–3 wt % of Mg, 3 wt %–10 wt % of at least one of Fe, Mn and Ni, and the balance consisting principally of aluminum; and in that:

the ratio of a tensile strength of said base disk to a specific gravity of said base disk (tensile strength [MPa]/specific gravity) is not smaller than 90, and the ratio of a fatigue strength of said base disk to said specific gravity of said base disk (fatigue strength [MPa]/specific gravity) is not smaller than 30.

9. A disk-shaped grindstone according to claim 8, wherein said rapidly-solidified aluminum alloy includes Si particles whose average diameter is not larger than 5 $\mu$m.

10. A disk-shaped grindstone according to claim 8, wherein said rapidly-solidified aluminum alloy has a porosity not larger than 1 vol %.

11. A disk-shaped grindstone according to claim 8 wherein said abrasive layer includes a plurality of abrasive segments are bonded to an outer circumferential surface of said base disk, said disk-shaped grindstone is used for a centerless grinding operation.

12. A disk-shaped grindstone according to claim 8, wherein each of said abrasive segments includes a radially outer layer and a radially inner layer which are formed integrally with each other, said radially outer layer including super abrasive grains that are held together by a bonding agent, said radially inner layer including abrasive grains which have a lower degree of hardness than said super abrasive grains and which are held together by the same boding agent as said bonding agent.

13. A disk-shaped grindstone according to claim 12, wherein said super abrasive grains have been subjected to a heat treatment, so as to reduce a toughness of said supper abrasive grains.

14. A disk-shaped grindstone according to claim 13, wherein said heat treatment is performed at a temperature of 400–1200° C. under vacuum or in a non-oxidizing gas atmosphere in the absence of oxygen.

* * * * *